US009003798B2

(12) United States Patent
Yanagi

(10) Patent No.: US 9,003,798 B2
(45) Date of Patent: Apr. 14, 2015

(54) ORGANIC RANKINE CYCLE SYSTEM

(75) Inventor: Hideharu Yanagi, Singapore (SG)

(73) Assignee: Cyclect Electrical Engineering Pte., Singapore (SG)

( * ) Notice: Subject to any disclaimer, the term of this patent is extended or adjusted under 35 U.S.C. 154(b) by 0 days.

(21) Appl. No.: 14/375,667

(22) PCT Filed: Mar. 15, 2012

(86) PCT No.: PCT/IB2012/051236

§ 371 (c)(1),
(2), (4) Date: Jul. 30, 2014

(87) PCT Pub. No.: WO2013/136131

PCT Pub. Date: Sep. 19, 2013

(65) Prior Publication Data

US 2014/0373542 A1 Dec. 25, 2014

(51) Int. Cl.
*F01K 25/08* (2006.01)
*F01K 7/06* (2006.01)
(Continued)

(52) U.S. Cl.
CPC ..... *F01K 25/08* (2013.01); *F01D 17/08* (2013.01); *F01D 17/085* (2013.01); *F01K 7/02* (2013.01); *F01K 7/04* (2013.01); *F01K 23/10* (2013.01); *F01D 15/10* (2013.01); *F01K 13/02* (2013.01); *F01K 23/02* (2013.01)

(58) Field of Classification Search
CPC ..... F01K 25/08; F01K 7/04; F01K 7/02; F01K 13/02; F01K 23/02; F01K 23/10; F01D 17/085; F01D 17/08; F01D 15/10
USPC ..... 60/651, 653, 660, 662, 677
See application file for complete search history.

(56) References Cited

U.S. PATENT DOCUMENTS 4,428,190 A * 1/1984 Bronicki ..... 60/655
5,531,073 A 7/1996 Bronicki et al.
(Continued)

FOREIGN PATENT DOCUMENTS

KR 10-0814940 3/2008
KR 10-2011-0128747 11/2011

OTHER PUBLICATIONS

Yanagi, Hideharu; International Search Report and Written Opinion for PCT Application No. PCT/IB2012/051236, filed Mar. 15, 2012, mailed Nov. 16, 2012, 9 pgs.

*Primary Examiner* — Hoang Nguyen
(74) *Attorney, Agent, or Firm* — Taylor English Duma LLP

(57) ABSTRACT

The application discloses an organic Rankine Cycle system with a generating unit, a condenser for condensing an organic work fluid, a feeder pump for circulating the organic work fluid and an evaporator (14) for evaporating the organic work fluid. The generating unit comprises a high-pressure screw expander and a low-pressure screw expander, which are connected in series, wherein the high-pressure screw expander and the low-pressure screw expander are mechanically connectable to a generator, which is provided between the high-pressure screw expander and the low-pressure screw expander. The ORC system comprises a by-pass line for bypassing the high-pressure screw expander. The bypass line comprises a control valve for opening and closing the by-pass line.

16 Claims, 9 Drawing Sheets

(51) Int. Cl.

| | |
|---|---|
| ***F01D 17/08*** | (2006.01) |
| ***F01K 7/02*** | (2006.01) |
| ***F01K 7/04*** | (2006.01) |
| ***F01K 23/10*** | (2006.01) |
| ***F01D 15/10*** | (2006.01) |
| ***F01K 13/02*** | (2006.01) |
| ***F01K 23/02*** | (2006.01) |

(56) References Cited

U.S. PATENT DOCUMENTS

| | | | | |
|---|---|---|---|---|
| 7,225,621 | B2 | 6/2007 | Zimron et al. | |
| 7,665,304 | B2 * | 2/2010 | Sundel | 60/671 |
| 8,015,812 | B1 * | 9/2011 | Kesseli et al. | 60/677 |
| 2003/0213246 | A1 * | 11/2003 | Coll et al. | 60/653 |

* cited by examiner

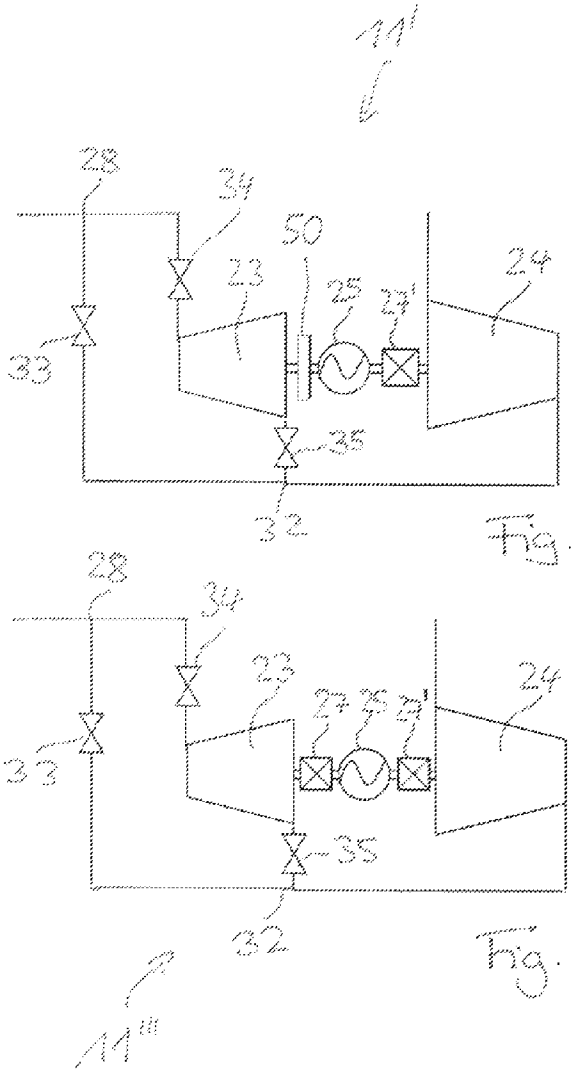
Fig. 4
Fig. 5
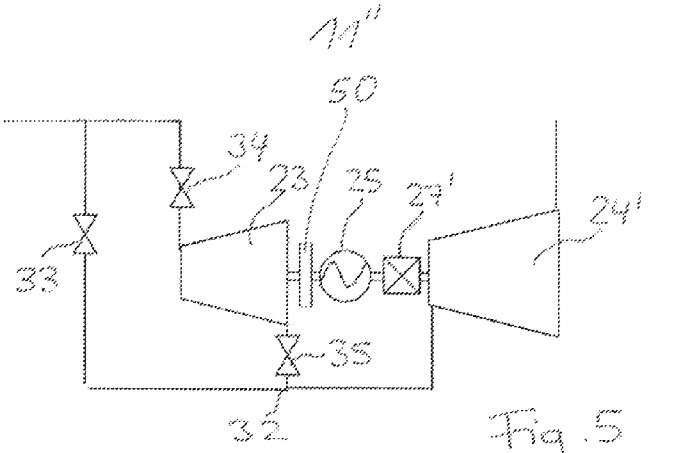
Fig. 6
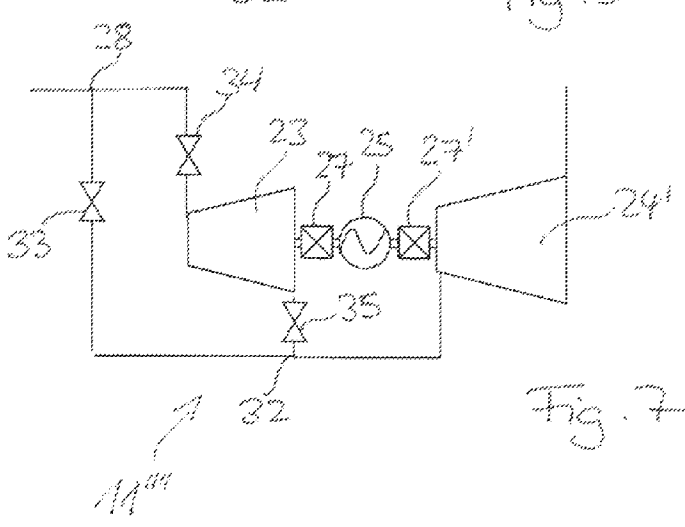
Fig. 7

ORGANIC RANKINE CYCLE SYSTEM

TECHNICAL FIELD

The present disclosure relates to thermal systems for converting thermal energy, specifically systems utilizing organic Rankine cycles.

BACKGROUND

An Organic Rankine cycle (ORC) is named for its use of an organic, high molecular mass fluid with a liquid-vapor phase change, or boiling point, occurring at a lower temperature than the water-steam phase change. The fluid allows Rankine cycle heat recovery from lower temperature sources such as biomass combustion, industrial waste heat, and waste heat from various small-scale heat engines, fuel cells or electric devices, geothermal heat, solar ponds, energy from combustion or decomposition of biodegradable materials. The low-temperature heat is converted into useful work that can itself be converted into electricity.

An idealized Clausius-Rankine cycle, also known as Rankine cycle, is characterized by an isentropic expansion, a heat dissipation at constant temperature, isentropic compression and an isobaric heating, which may be followed by a superheating. In a real Rankine cycle, the steps of expansion and compression are not exactly isentropic but the entropy increases slightly.

In the case of a "dry fluid", the Rankine cycle can be improved by the use of a regenerator. In a temperature—entropy diagram, a dry-fluid is characterized by an overhanging mixed phase to vapour phase boundary. The dry fluid, which has not reached the two-phase state at the end of the expansion, has a temperature that is higher than the condensing temperature. The higher temperature fluid can be used to preheat the work fluid before it enters the evaporator.

SUMMARY

It is an object of the application to provide an improved ORC cycle system for operation under high and low temperature conditions.

The application discloses an organic Rankine Cycle system with a generating unit, a condenser for condensing an organic work fluid, a feeder pump for circulating the organic work fluid, and an evaporator for evaporating the organic work fluid. It is advantageous to use organic work fluids for low temperature applications. By choosing suitable organic compounds, they can be tailored to the application with respect to the boiling point and other thermal properties. Organic liquids are also usually less corrosive than water.

According to the application, the generating unit comprises a high-pressure screw expander and a low-pressure screw expander which are connected in series. Thereby, the heat can be used effectively without the need to make the expanders very big. Screw expanders are often better than turbines for use in compact machines rather as compared to large scale steam engines for atomic power plants, for example. The high-pressure screw expander and the low-pressure screw expander are mechanically connectable to a generator which is provided between the high-pressure screw expander and the low-pressure screw expander. The arrangement of the generator between the expanders according to the application yields a compact and robust design.

The ORC system further comprises a by-pass line for bypassing the high-pressure screw expander, wherein the bypass line comprises a control valve for opening and closing the by-pass line. Under conditions when the temperature of a heat source to which the evaporator is connected is low it can be advantageous to disconnect the high-pressure turbine and to use just the low-pressure turbine.

In a waste recovery system for an engine such a condition can occur, for example, when the engine has just started and does not provide sufficient exhaust heat to drive both of the expanders. On the other hand, it can also be advantageous to disconnect a previously closed bypass and use both expanders in situations when a temperature of a heat source is higher than it was before. This could occur in a geothermal power station, when a bore hole is drilled to a greater depth with a higher temperature or when the ORC machine is moved or connected to a different geothermal heat source. If heat from volcanic heat sources or from geysers is harnessed, the temperature may also change over time. These changes may be periodic changes, especially for geysers, or also long-term changes.

According to the one embodiment, the high-pressure expander is mechanically connectable to the generator via a freewheeling device. This provides a simple way of disconnecting from the high-pressure expander from the low-pressure expander.

According to the application, the bypass can be activated and deactivated by providing an input control valve and an output control valve. The high-pressure expander is arranged in the flow path of the work fluid between the input control valve and the output control valve. The high-pressure expander can be shut off from the work flow current from the input and the output side by closing the input control valve and the output control valve.

Furthermore, the Organic Rankin Cycle system may comprise one or more gear sets in order to adapt the generator speed to the output speed of the expanders for operating the generator close to a desired working point.

According to one embodiment, the generating unit comprises a first spur gear that is connected to the high-pressure expander and a second spur gear (64) that is connected to the low-pressure expander (24).

According to another embodiment the ORC system comprises a first planetary gear set that is connected to the high-pressure expander a second planetary gear set that is connected to the low-pressure expander. While a spur gear is easy to realize, a planetary gear can provide a higher reduction ratio for a given dimension.

In yet another embodiment of the ORC system, the generating unit comprises a planetary gear set, wherein a sun gear of the planetary gear set is connected to the high-pressure expander and a planetary carrier of the planetary gear set is connected to the low-pressure expander. With a planetary gear set which is connected in this way, the output of the two expanders can be used simultaneously.

According to one embodiment, the ORC system comprises a work fluid which is an azeotropic mixture, the azeotropic mixture comprising a first organic fluid with a normal boiling point in a temperature above 35° C. and a second organic fluid which is of low flammability. The boiling point of above 35° C. is advantageous when the temperature of the cooling fluid is as warm as 30° or even slightly warmer. This situation occurs for a ship in tropical latitudes. The low flammability is important for security reasons to prevent a fire on board a ship in which the ORC system is installed. This also applies to other environments, in which flammable substances such as oil are close to the ORC system.

In order to achieve these desired properties, the first organic fluid of the work fluid may comprise a pentafluorobutane and the second organic fluid may comprise a perfluoropolyether.

In particular, the condenser and/or the evaporator may comprise a plate heat exchanger. This type of heat exchanger is advantageous for situations in which the ORC engine is moving around. Movements of the fluid within the heat exchanger are constrained by the geometry of the plate heat exchanger.

In particular, the expanders may be realized as oil-free expanders. Thereby, it is not necessarily to mix oil into the working fluid which could deteriorate the properties of the working fluid.

Furthermore, the application discloses a ship engine with an aforementioned ORC system wherein the evaporator of the ORC system is connected to an exhaust of the ship engine via a pipe. The pipe may be filled with a circulating thermal oil that acts as a heat transporter.

In another embodiment, the application discloses a geothermal power station with the aforementioned ORC system wherein the evaporator of the ORC system is connected to a pipe for a brine of the geothermal power station, the pipe being connected to the geothermal heat source via a borehole. The brine is injected into the heat source or, in the case of a geyser, it may also be provided by the geothermal heat source itself.

Moreover, the application discloses a method for operating an ORC system with a high-pressure expander and a low-pressure expander. Therein, the ORC system comprises a bypass line that extends, in a flow direction of the working fluid, from a branching point before the high-pressure expander to the low-pressure expander. The ORC system furthermore comprises an input control valve before the high-pressure expander.

In a high temperature operating mode the bypass line is closed and the input control valve is opened. In a low temperature operating mode the bypass line is opened and the input control valve is closed. Thereby, the ORC system can be adapted to different temperature conditions without the need to provide to different ORC systems.

Furthermore, the method may comprise steps of measuring a temperature of a heat source and automatically selecting one of the high-pressure operation mode and the low-pressure operation based on the temperature of the heat source. This embodiment is advantageous, when a temperature of the heat source can change more rapidly.

BRIEF DESCRIPTION OF THE DRAWINGS

The subject matter of the application will now be explained in further detail with reference to the following Figures in which FIG. 4 shows a generation unit with a clutch, FIG. 5 shows a generation unit with a clutch with an alternative orientation of the low-pressure expander, FIG. 6 shows a generation unit with two freewheeling devices, FIG. 7 shows a generation unit with two freewheeling devices with an alternative orientation of the low-pressure expander.

DETAILED DESCRIPTION

In the following description, details are provided to describe the embodiments of the application. It shall be apparent to one skilled in the art, however, that the embodiments may be practised without such details. In the following description, the same reference numbers refer to the same or similar parts and primed reference numbers refer to similar parts. The expression "generating unit (11, 111)" refers to all embodiments of the generating unit.

Similar parts have the same reference numbers. Different embodiments of similar parts are marked with primes.

Figure 1:
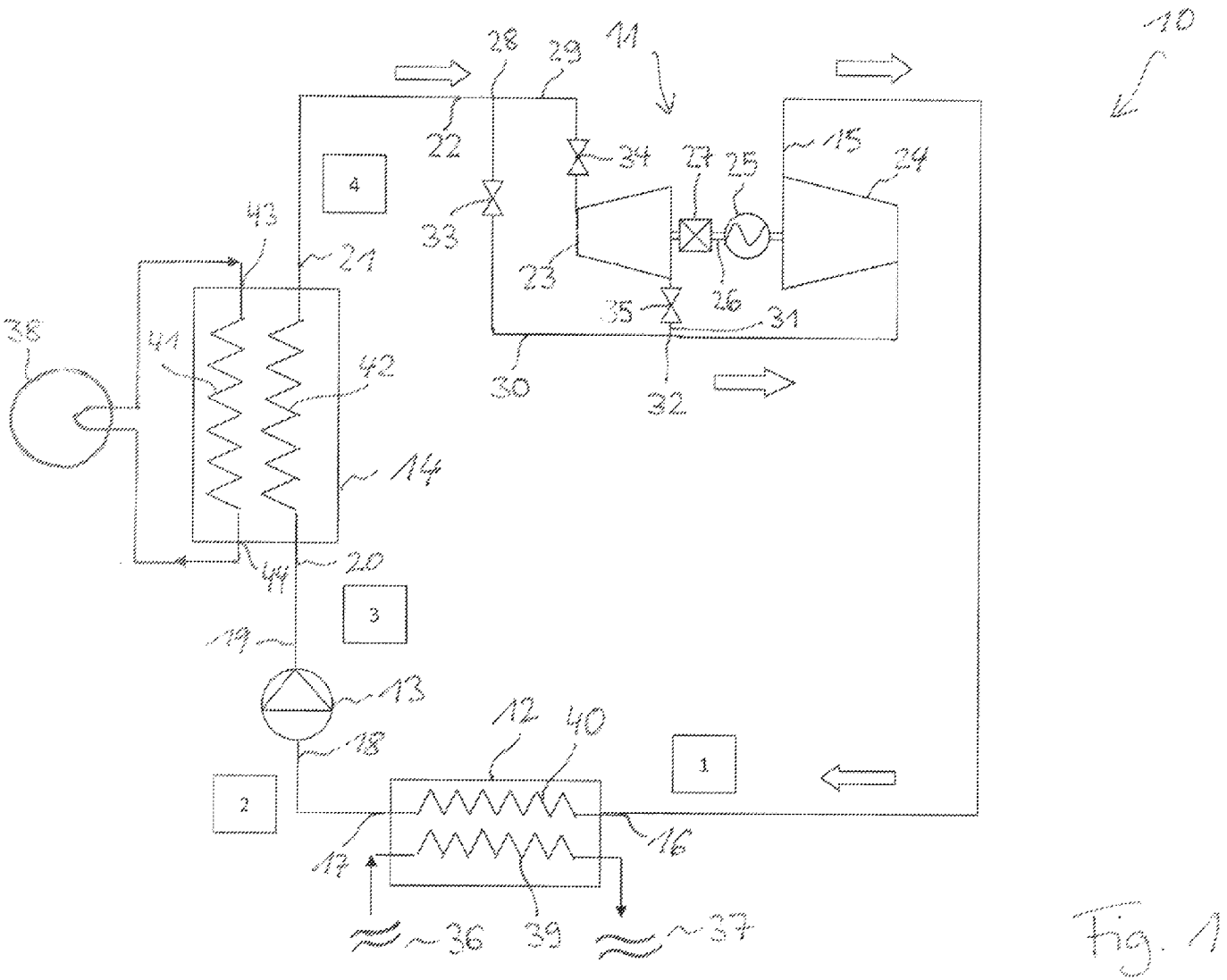
FIG. 1 shows an ORC system according to the application.

FIG. 1 shows an Organic Rankine Cycle (ORC) system 10. The ORC system 10 comprises, in the sense of a work fluid flow, a generating unit 11, a condenser 12, a feed pump 13, and an evaporator 14. Respective work fluid pipes connect a work fluid outlet 15 of the generating unit 11 with a work fluid inlet 16 of the condenser 12, a work fluid outlet 17 of the condenser 12 with a work fluid inlet 18 of the feeder pump 13, a work fluid outlet 19 of the feeder pump 13 with a work fluid inlet 20 of the evaporator 14 and a work fluid outlet 21 of the evaporator 14 with a work fluid inlet 23 of the generating unit 11 such that a closed work flow loop is formed.

The expander screws are oriented such that the high-pressure expander 23 and the low-pressure expander 24 turn in the same direction when they are pressurized via their respective work fluid inputs. The freewheel clutch 27 is connected such that the freewheel clutch is disengaged when the low-pressure expander 24 turns faster than the high-pressure expander 23 and is engaged when the high-pressure expander 23 turns faster than the low-pressure expander 24.

The generating unit 11 comprises a high-pressure expander 23 and a low-pressure expander 24. The high-pressure expander 23 and the low-pressure expander 24 are connected to a generator 25 via a shaft 26. According to the application, the generator 25 is provided by an alternating current generator 25, for example by a three phase generator such as a cylindrical rotor generator, a salient pole generator, or a claw pole generator.

The generator 25 is arranged between the high-pressure expander 23 and the low-pressure expander 24. A freewheeling device 27 is provided between the generator 25 and the high-pressure expander 23. The shaft 25 comprises at least a first section, which connects the high-pressure expander 23 and a first input of the freewheeling device 27, and a second section, which connects a second input of the freewheeling device 27 and the generator 25.

At a first branching point 28 behind the work fluid input 22 of the generating unit 11, the fluid pipe branches off into a high-pressure supply line 29 that is connected to a work fluid input of the high-pressure expander 23 and into a low-pressure supply line 30 that is connected to a work fluid input of the low-pressure expander 24. A high-pressure exhaust line 31 that is connected to a work fluid output of the high-pressure expander 23 leads into the low-pressure supply line at a second branching point 32. A bypass control valve 33 is provided between the first branching point 28 and the second branching point 32 at the low-pressure supply line 30. An input control valve 34 is provided between the first branching point 28 and the work fluid input of the high-pressure expander 23. An output control valve 35 is provided between the work fluid output of the high-pressure expander 23 and the second branching point 32. A flow direction of the work fluid is indicated by arrows.

The condenser 12 is realized as a plate heat exchanger that comprises one or more channels 39 for cooling water and one or more channels 40 for the work fluid. The channel for cooling water 39 is connected to a cooling water source 36 at one end and to a cooling water sink 37 at the other end. For a ship, the cooling water source and sink can be realized by input and output ports which are connected to sea water. For a geothermal energy plant, the cooling water can be provided by a freshwater source or by circulating cooling water, which is recycled after it has cooled down. The cooling process of the cooling fluid may be accelerated by using a cooling tower or other heat exchangers.

Similar to the condenser 12, the evaporator 14 is realized as a plate heat exchanger that comprises a heating fluid inlet 43, one or more channels 41 for a heating fluid, a heating fluid outlet 44 and one or more channels 42 for the work fluid. For waste energy recuperation, the heating fluid can be provided by a thermal oil which takes up heat from a heat source 38 and which is circulated in a closed loop. In the case of a geothermal heat source, the heating fluid, also known as "injection brine", is provided by a heated water or steam which is pumped out from the geothermal heat source and injected back into it.

According to the application, the expanders 23, 24 are preferentially realized as essentially oil-free expanders. In this context "oil-free" expanders refers to expanders in which the screw surfaces are lubricated through the work fluid. In one embodiment, the freewheeling device 27 is realized as a sprag type freewheel which has low friction. In addition or alternatively, a clutch may be provided, for example an electromagnetic clutch to decouple the motion of the low-pressure expander 24 from the motion of the high-pressure expander 23.

By using a two-stage expander, the expanders can be made smaller, such that they fit into the limited space of a ship's engine room. When a work fluid according to the application is used, the dimensions of the expanders can be made such that they each provide an expansion ratio of about 5.

In FIG. 1, measuring locations for thermodynamic state quantities of the work flow are marked by squared numbers "1" to "4". The thermodynamic state quantities comprise directly measurable state quantities, such as pressure and temperature, as well as derived state quantities, such as specific enthalpy and entropy. A "1" denotes a measuring location between the generating unit 11 and the condenser 12, a "2" denotes a measuring location between the condenser 12 and the feeder pump 13, a "3" denotes a measuring location between the feeder pump 13 and the evaporator 14 and a "4" denotes a measuring location between the evaporator 14 and the generating unit 11. The measuring locations correspond to start and end points of process sections of a Clausius-Rankine cycle.

Figure 2:
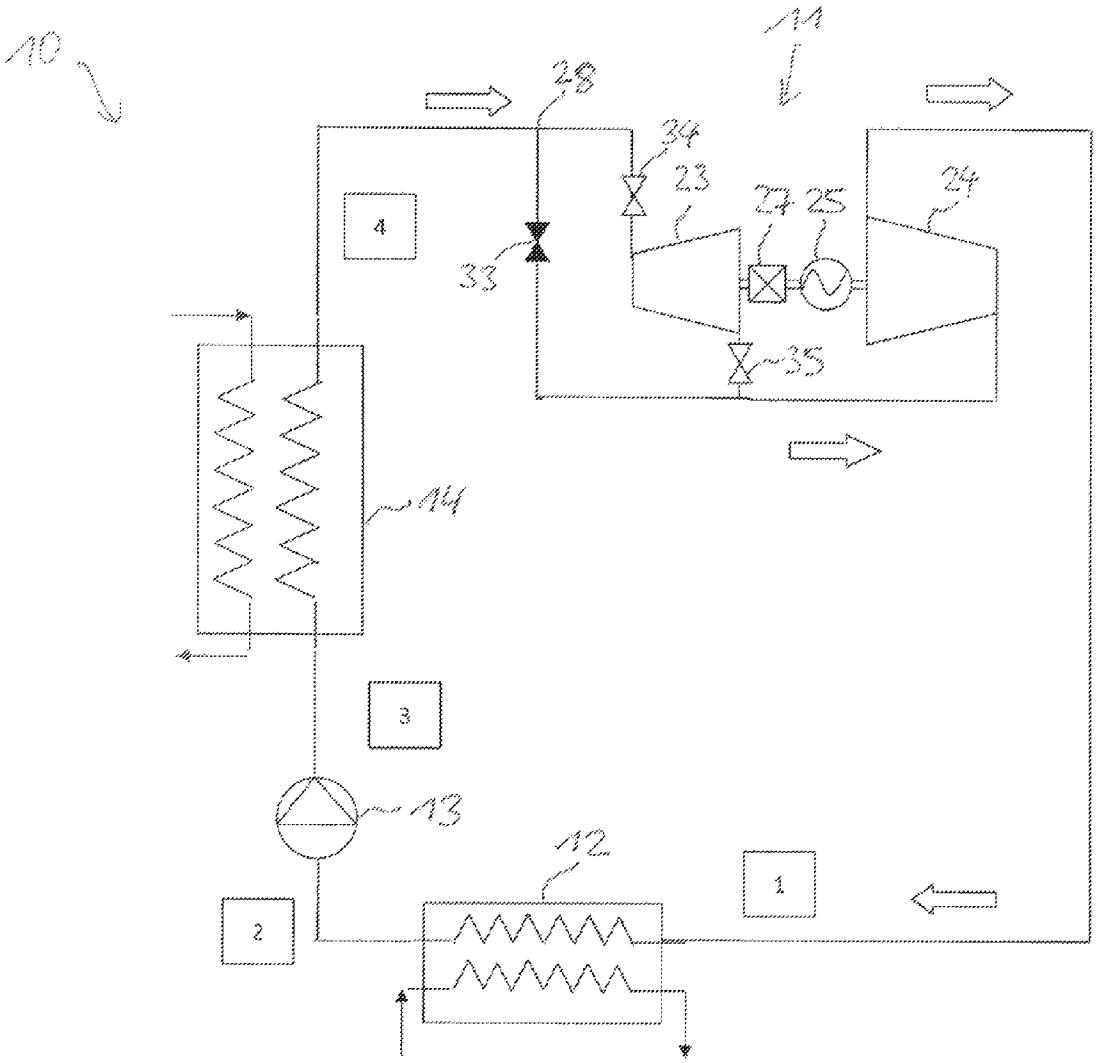
FIG. 2 shows the ORC system of FIG. 1 in a high-pressure operation mode.

FIG. 2 shows the ORC system 10 of FIG. 1 in a high-pressure mode, also referred to as high temperature mode. The high-pressure mode is especially advantageous for waste heat recovery from heat sources which have substantially higher temperatures than 100° C. These conditions apply to combustion motors but also to some geothermal heat sources, for example.

In the high-pressure mode, the bypass valve is closed and the input valve and the output valve of the high-pressure expander 23 are open. During operation, work fluid in the gaseous phase is supplied to the high-pressure expander 23, the work fluid, which is still in the gaseous phase, is expanded in the high-pressure expander 23 and discharged through the output valve of the high-pressure expander. Then, the work fluid flows to the low-pressure expander 24 and is expanded in the low-pressure expander. The work fluid, which is still in the gaseous state, is then discharged from the generating unit 11. The faster revolving one of the high-pressure expander 23 and the low-pressure expander 24 drives the shaft 26 and there by the rotor of the electricity generator 25.

If the high-pressure expander 23 turns faster than the low-pressure expander 24, the freewheel 27 engages and the high-pressure expander 23 turns the rotor of the generator and the low-pressure expander 24. If, on the other hand, the low-pressure expander 24 turns faster than the high-pressure expander, the freewheel 27 disengages and the low-pressure expander 24 turns the rotor of the generator. Thereby, the low-pressure expander 24, which is now under load, will slow down again.

The remaining cycle of the work fluid is similar to a standard ORC cycle and is omitted here for brevity.

Figure 3:
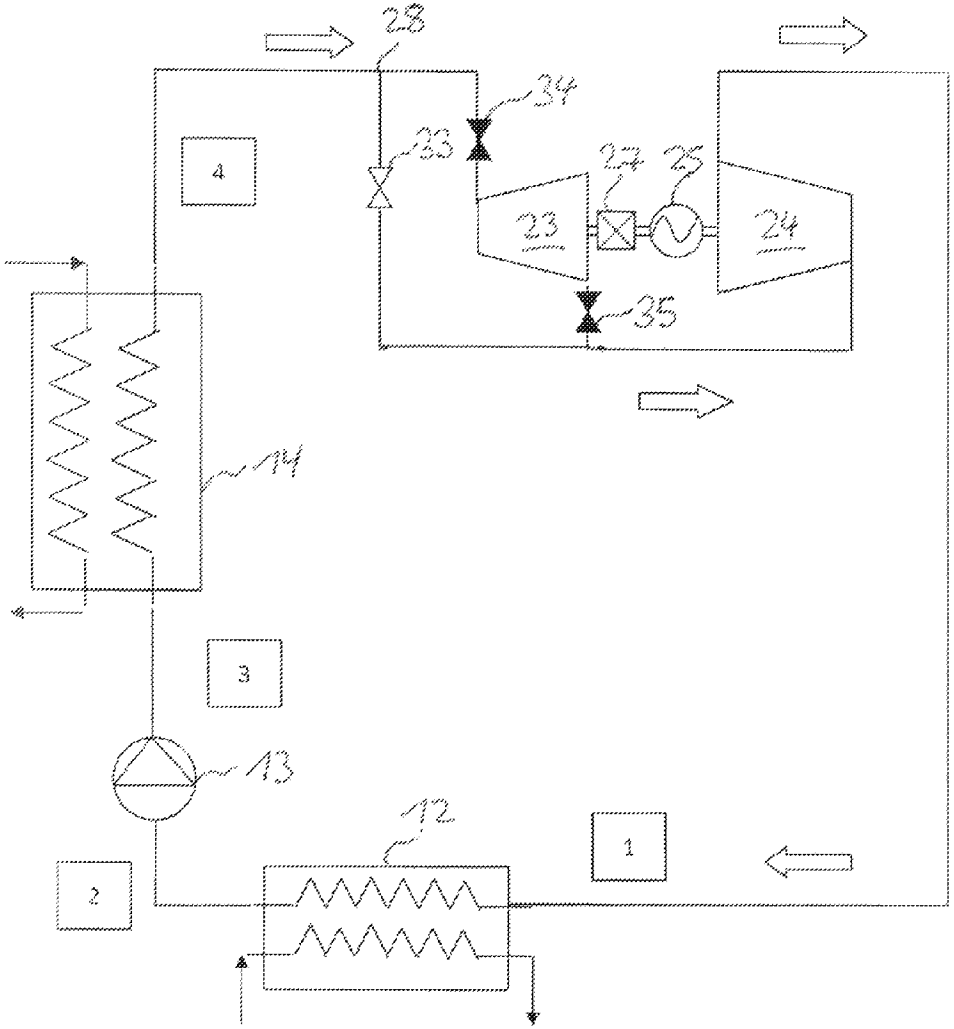
FIG. 3 shows the ORC system of FIG. 2 in a low-pressure operation mode.

FIG. 3 shows the ORC system 10 of FIG. 1 in a low-pressure mode, also referred to as low temperature mode. The low-pressure mode is especially advantageous for waste heat recovery from heat sources which have temperatures of only about 100° C. or lower. These conditions apply, for example, to low temperature geothermal sources or to the decomposition of biodegradable substances.

In the low-pressure mode, the bypass valve is opened whereas the input valve and the output valve of the high-pressure expander is closed.

During operation, work fluid in the gaseous phase is supplied to the low-pressure expander 24. The work fluid, which is still in the gaseous phase, is expanded in the low-pressure expander 24 and discharged through the output valve of the low-pressure expander. The remaining cycle of the work fluid is similar to a standard ORC cycle and is omitted here for brevity.

The work fluid of the Rankine cycle system according to the application is an organic fluid in the form of an azeotropic mixture. Preferentially, the working fluid fulfils the following criteria.

1. non-toxic
2. non-flammable
3. non-corrosive and fouling resistant
4. material compatibility and suitable fluid stability limits
5. high latent heat and high density
6. low environmental impact
7. acceptable pressure range for screw expanders
8. safety In particular, SES36 is a suitable work fluid according to the application. SES36 is an azeotropic mixture of 365 mfc (1,1,1,3,3 pentafluorobutane) and PFPE (perfluoropolyether). While 365 mfc on its own already provides a good efficiency as an ORC work fluid, the addition of PFPE to 365 mfc has the benefit of reducing the reactiveness significantly.

The following table lists thermodynamic properties of SES36:

| Temperature [° C.] | Pressure [bar] | Liq. Density [kg/m3] | Vap. Density [kg/m3] | Liq. Enthalpy [kJ/kg] | Vap. Enthalpy [kJ/kg] | Liq. Entropy [kJ/(kgK)] | Vap. Entropy [kJ/(kgK)] |
|---|---|---|---|---|---|---|---|
| 0 | 0.263 | 1422.04 | 2.00 | 200.00 | 349.88 | 1.000 | 1.549 |
| 10 | 0.395 | 1400.14 | 2.89 | 207.26 | 359.64 | 1.026 | 1.564 |
| 20 | 0.579 | 1377.21 | 4.12 | 215.92 | 369.63 | 1.056 | 1.580 |
| 30 | 0.833 | 1353.24 | 5.77 | 226.05 | 379.70 | 1.090 | 1.597 |
| 40 | 1.174 | 1328.22 | 8.00 | 237.62 | 389.66 | 1.127 | 1.613 |
| 50 | 1.622 | 1302.16 | 10.97 | 250.50 | 399.25 | 1.168 | 1.628 |
| 60 | 2.200 | 1275.04 | 14.90 | 264.36 | 408.23 | 1.210 | 1.642 |
| 70 | 2.932 | 1246.85 | 20.08 | 278.74 | 416.31 | 1.252 | 1.653 |
| 80 | 3.845 | 1217.59 | 26.82 | 293.04 | 423.29 | 1.293 | 1.662 |
| 90 | 4.964 | 1187.26 | 35.45 | 306.69 | 429.05 | 1.331 | 1.668 |
| 100 | 6.316 | 1155.82 | 46.31 | 319.35 | 433.67 | 1.365 | 1.671 |
| 110 | 7.929 | 1123.24 | 59.79 | 331.04 | 437.38 | 1.396 | 1.673 |
| 120 | 9.831 | 1089.48 | 76.45 | 342.12 | 440.51 | 1.424 | 1.674 |
| 130 | 12.055 | 1054.38 | 97.20 | 353.16 | 443.37 | 1.451 | 1.675 |
| 140 | 14.636 | 1017.66 | 123.68 | 364.78 | 446.20 | 1.479 | 1.676 |
| 150 | 17.622 | 978.55 | 158.94 | 377.61 | 449.10 | 1.509 | 1.678 |
| 160 | 21.072 | 934.72 | 209.17 | 392.33 | 451.93 | 1.542 | 1.680 |
| 170 | 25.067 | 875.19 | 289.01 | 410.03 | 454.18 | 1.582 | 1.681 |

Further characteristics of the work fluid SES36 are summarized in the following table, in which "NBP" denotes the normal boiling point, cp' the liquid heat capacity for constant pressue, cp" the vapour heat capacity for constant pressure and cv" the vapour heat capacity for constant volume.

| Physical Property | Unit | Value |
|---|---|---|
| Molecular mass | g/mol | 184.53 |
| NBP | ° C. | 35.64 |
| Tcrit. | ° C. | 177.55 ± 0.5 |
| pcrit. | Bar | 28.49 ± 0.24 |
| crit. Density | kg/m_3 | 538 |
| liq. density @ NBP | kg/m_3 | 1339.25 |
| vap. density @ NBP | kg/m_3 | 6.95 |
| cp' @ NBP | J/(kg K) | 1167.2 |
| cp" @ NBP | J/(kg K) | 641.9 |
| cp"/cv"@ NBP | — | 1.01 |
| heat of vaporisation | kJ/kg | 152.94 |

By using SES36, which has a high boiling point of over 35° C., it is possible to use sea water as cooling fluid in a condenser, even under tropical conditions where the sea water may have temperatures as high as 30° C. Moreover, SES36 has a high vapour density. Thereby the expanders can be made more compact and with smaller expansion ratios.

In a first example, the ORC system in the high-pressure configuration of FIG. 2 is used in a ship to produce electric current from waste heat of a ship engine using SES36 as work fluid. In this example, the work fluid has a temperature T_1 of 40.15° C., a pressure p_1 of 1.26 bar and a specific enthalpy h_1 of 389.66 kJ/kg between the low-pressure expander 24 and the condenser.

Assuming typical water conditions in the tropics, the condenser takes in seawater at a temperature of 30° C. and ejects heated sea water at a temperature of about 35° C. Between the condenser and the feeder pump, the work fluid has a temperature T_2 of about 35.64, a pressure p_2 of 1 bar and a specific enthalpy h_2 of 236.72. These conditions correspond to the normal boiling point (NBP) of the work fluid SES36. Here, the specific enthalpy h_2 is the liquid enthalpy under the assumption that the condenser liquefies all of the work fluid.

The feeder pump circulates work fluid at about 0.345 liter/sec. Between the feeder pump and the evaporator, the work fluid has a temperature of 35.64° C., a pressure of 25 bar and a specific enthalpy h_3 of 239.62. The evaporator is fed by a thermal heat transfer oil which is heated up by the ship engine to about 230° C. When the thermal oil is ejected again from the evaporator it has an outlet temperature of about 80° C. The high-pressure expander 23 and the low-pressure expander 24 drive the generator such that an output power P_gen of about 20 kW=20 kJ/sec is produced.

A first estimate of the thermal efficiency η_th under the conditions of the first example is given by the quotient $$\eta_{th} \approx \frac{P_{gen}}{(h_4 - h_2) * \dot{m}_{pump}}$$

Assuming a work fluid temperature T_4 of 170° C., a pressure p_4 of 25.06 bar and a corresponding specific vapour enthalpy of 454.18 kJ/kJ at the inlet of the high-pressure expander 23, and with a liquid density of 1339.25 kg/m$^3$ at NBP, the quotient yields an approximate thermal efficiency of:

$$\eta_{th} \approx \frac{20\frac{\text{kJ}}{\text{sec}}}{(454.18 - 236.72)\frac{\text{kJ}}{\text{kg}} * 0.345\frac{1}{\text{sec}} * 1.33925\frac{\text{kg}}{\text{l}}} \approx 20\%$$

In a second example, the ORC system in the low-pressure configuration of FIG. 3 is used in a geothermal energy plant to produce electric current geothermal heat using SES36 as work fluid. It is assumed here that the geothermal heat is sufficient to heat water to the boiling point. Higher or lower temperatures may be achieved as well, depending on the nature of the geothermal source and the water injection process.

In this example, the work fluid has a temperature T_1 of 40.15° C., a pressure p_1 of 1.26 bar and a specific enthalpy h_1 of 389.66 kJ/kg between the low-pressure expander 24 and the condenser. Between the condenser and the feeder pump, the work fluid has a temperature T_2 of about 35.64°

C., a pressure p_2 of 1 bar and a specific enthalpy h_2 of 236.72. These conditions correspond to the normal boiling point (NBP) of the work fluid SES36. Here, the specific enthalpy h_2 is the liquid enthalpy under the assumption that the condenser liquefies all of the work fluid. Between the feeder pump and the evaporator, the work fluid has a temperature of T_3 of 35.64° C., a pressure p_3 of 6.136 bar and a corresponding specific enthalpy h_3 of 239.62 kJ/kg. Between the evaporator and the inlet of the low-pressure expander 24, the work fluid has a temperature T_4 of 100° C., a pressure of 6.136 bar and a corresponding specific enthalpy of 433.67 kJ/kg. A work fluid mass flow through the low-pressure expander is 0.4544 kg/sec.

These enthalpy values yield a theoretical thermal efficiency of $$\eta_{th} = \frac{(h_4 - h_1) - (h_3 - h_2)}{(h_4 - h_3)} = \frac{(433.67 - 389.66) - (239.62 - 236.72)}{(433.67 - 239.62)} \approx 21\%$$

For the real process one needs to consider that the feeder pump and the expanders have efficiencies below 1, for example the pump may have an efficiency of only 0.8 and the expander an efficiency of only 0.75. This yields $$\eta_{th} = \frac{(433.67 - 389.66) * 0.75 - (239.62 - 236.72) * 10/8}{(433.67 - 239.62)} \approx 15\%$$

In summary, the thermal efficiency of the ORC system using SES36 fluid according to the application is as high as 20% for the high temperature example and still at about 15% for the low temperature example.

FIG. 4 shows another embodiment of a generating unit 11' in which a clutch 50 is provided between the generator 25 and the high-pressure expander 23 and a freewheel device is provided between the generator 25 and the low-pressure expander.

FIG. 5 shows an embodiment of a generating unit 11" which is similar to the embodiment of FIG. 4 but in which the low-pressure side of the low-pressure expander 24' faces towards the generator.

FIG. 6 shows an embodiment of a generating unit 11''' in which a first freewheel device 27 is provided between the generator 25 and the high-pressure expander 23 and a second freewheel device 27' is provided between the generator 25 and the low-pressure expander 24.

FIG. 7 shows an embodiment of a generating unit 11'''' which is similar to the embodiment of FIG. 4 but in which the low-pressure side of the low-pressure expander 24' faces towards the generator.

Figure 8:
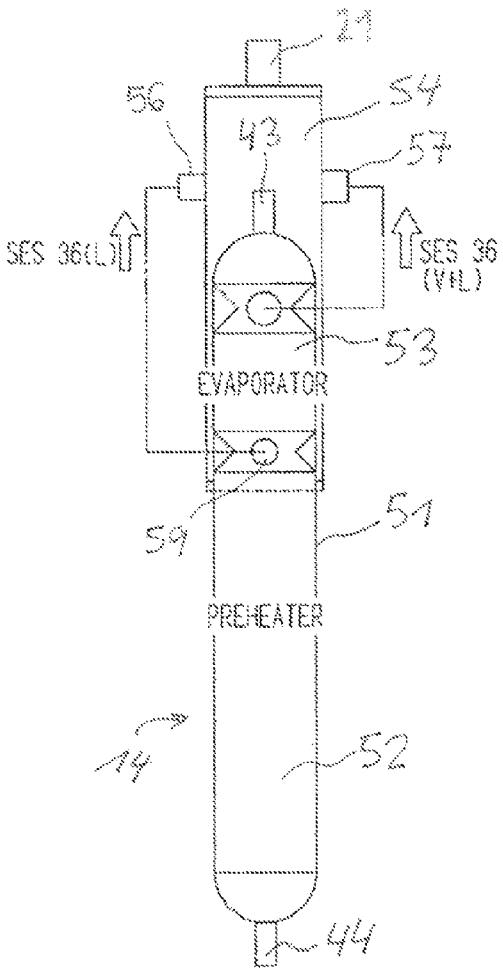
FIG. 8 shows a first view of an evaporator.

FIG. 8 shows an evaporator 14 for use in the embodiments of the application. The evaporator 14 comprises a plate heat exchanger 51 with a preheater portion 52 or first heat exchanger 52 and an evaporator portion 53 or second heat exchanger 53 as well as a separator chamber 54, also referred to as liquid receiver tank 54. The separator chamber 54 comprises a liquid outlet 55 at the bottom, a liquid inlet 56 and a vapour inlet 57 at the top. According to the embodiment of FIG. 8, the height of the separator chamber 54 is higher than the height of evaporator 53. Thereby, the vapour region remains separate from the liquid region under movements of a ship.

The liquid outlet 55 is connected to a liquid inlet 58 at the bottom of the evaporator section 53. The liquid inlet 56 is connected to a liquid outlet 59 at the bottom of the evaporator portion 53. The vapour inlet 57 is connected to a vapour outlet 60 at the top of the heating portion 53. Furthermore, the evaporator 14 comprises an inlet 43 and an outlet 44 for a heating fluid such as thermo oil, water steam or hot water.

Figure 9:
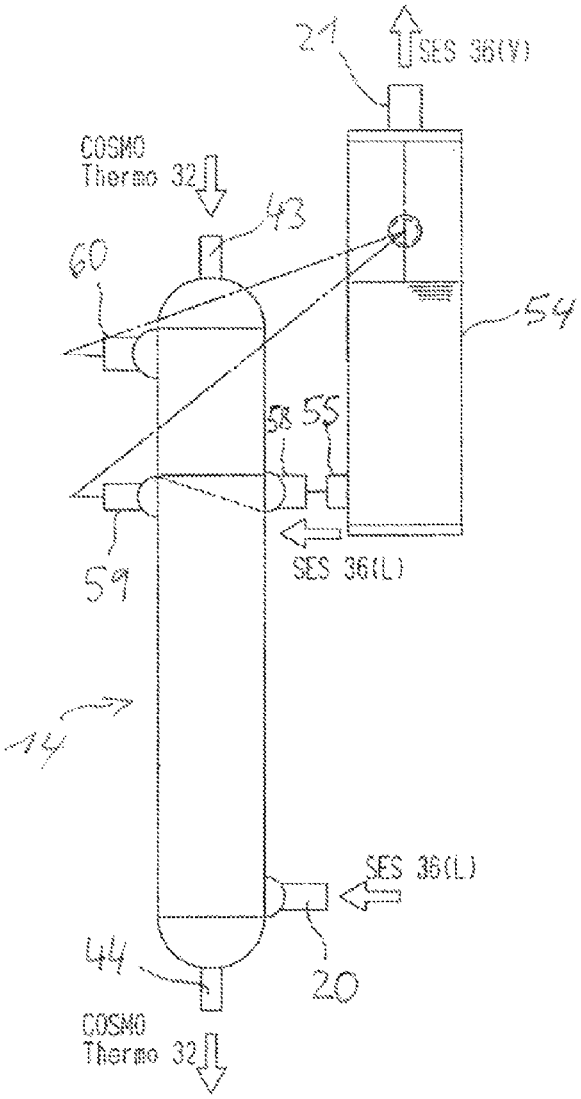
FIG. 9 shows a second view of an evaporator.

FIG. 9 shows a side view of the evaporator 14 of FIG. 8. A work fluid in a liquid state is referred to in FIGS. 8 and 9 as "SES 36 Liquid" and a work fluid in a coexistence region of liquid and vapour is referred to as "SES 36 vapour+ liquid".

During operation of the evaporator 14, a feeding liquid, also known as work fluid, is pre-heated by the first heat exchanger 52 up to the boiling temperature and is fed to the liquid receiver tank 54. The work fluid is then fed to the second heat exchanger 53 and converted into vapour. The vapour is fed back to the top of the receiver tank 54 and the vapour from the top of the receiver tank 54 is supplied to the expander 23 or 24 via the outlet 21.

A flow of the work fluid through the evaporator is as follows: From the first heat exchanger inlet 20 to the outlet 59 to the tank inlet 56 to the tank outlet 55 via the second heat exchanger inlet 58 and the outlet 60 to the tank inlet 57 to the tank vapour outlet 21 to an inlet of a turbine or expander. A flow of a heating oil, which is referred to as "thermo 32 oil" in FIGS. 8 and 9, extends from the inlet 43 via pipes of the evaporator to the outlet 44.

Figure 10:
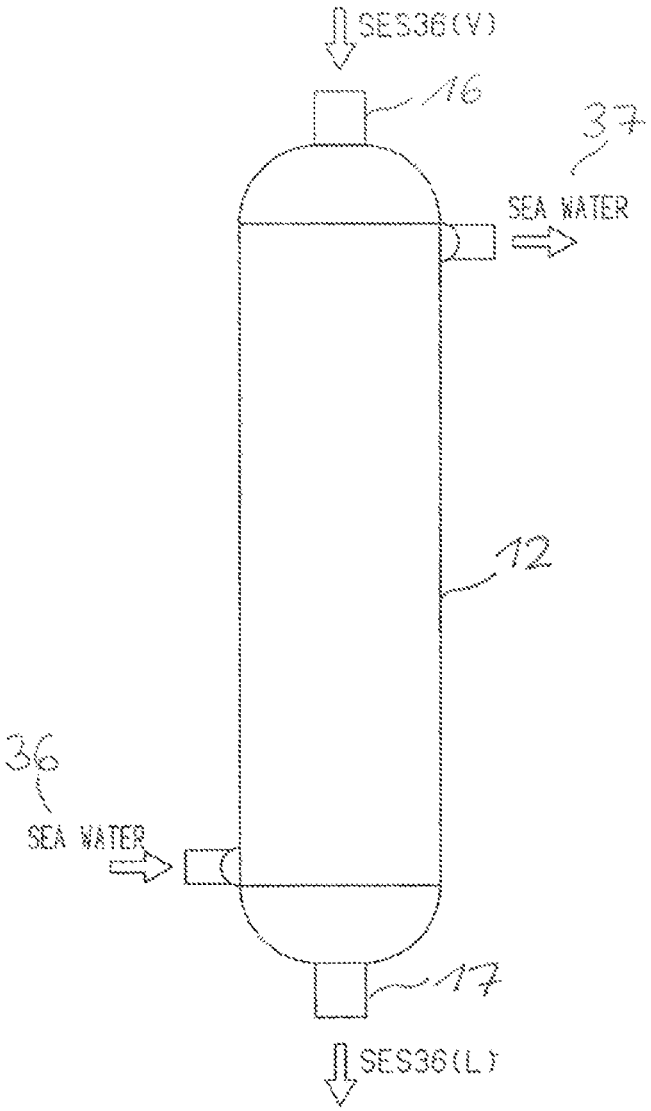
FIG. 10 shows a first view of a condenser.

FIG. 10 shows a condenser 12 for use in the embodiments of the application. The condenser 12 comprises a cooling fluid inlet at a lower left portion, a cooling fluid outlet at an upper right portion, a work fluid inlet 16 at a top portion and a work fluid outlet 17 at a bottom portion.

For use in a ship, it is advantageous if the condenser and evaporator comprise plate heat exchangers due to conditions in the ship. However, for a geothermal or other ground based power station or waste recovery system, the ORC system is not moving and other types of heat exchangers may be used as well.

Figure 11:
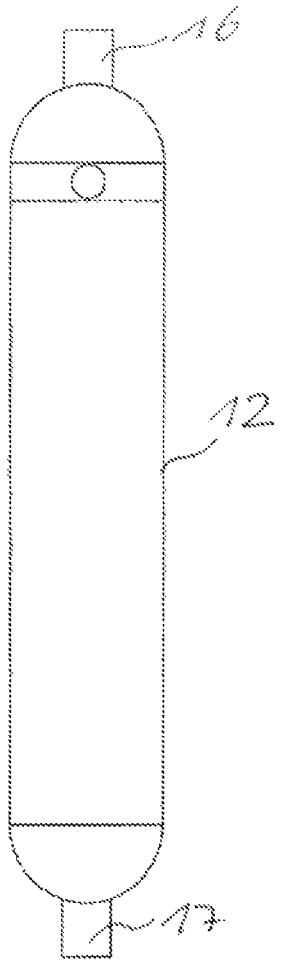
FIG. 11 shows a second view of a condenser, FIG. 12 a schematic process diagram of the ORC system of FIG. 1.

FIG. 11 shows a side view of the condenser 12 in which the cooling fluid outlet is shown in a frontal view. In the interior of the heat exchanger, the fluid channels of the work fluid and/or of the cooling fluid may branch off into several channels which are in thermal contact with each other. Another embodiment comprises undulating channels. While many undulations and/or fluid channels improve the heat exchange, fewer undulations and/or fluid channels have a smaller flow resistance.

Figure 12:
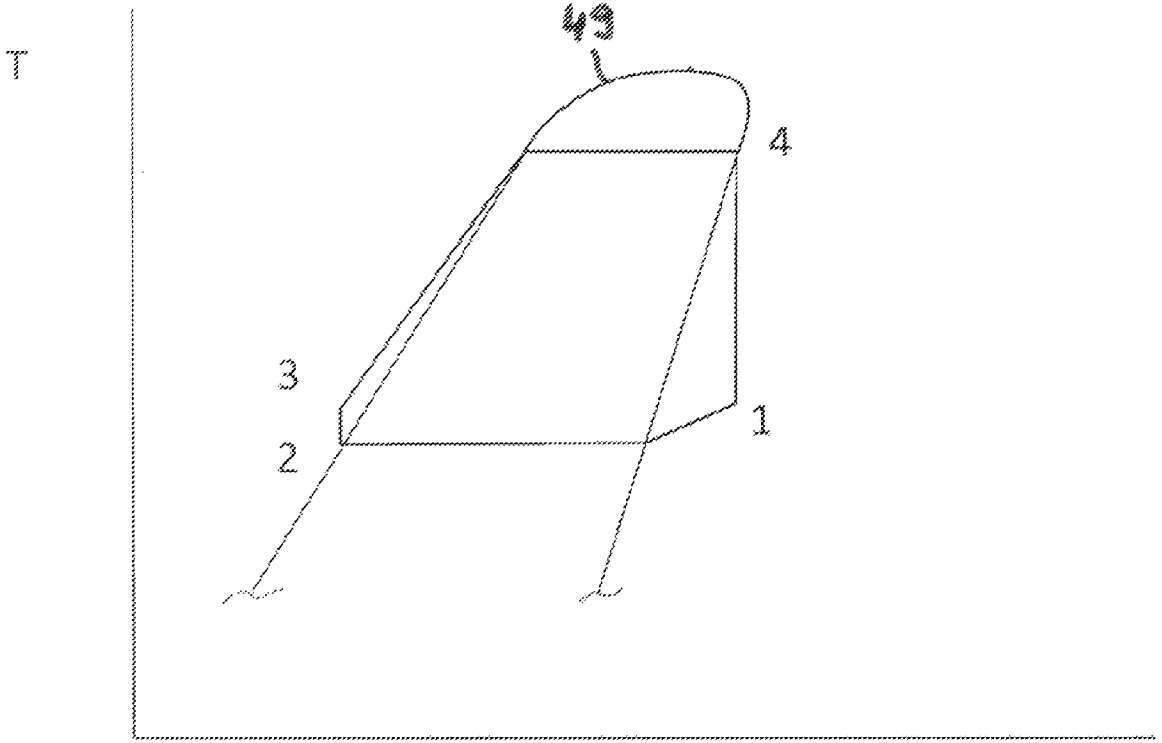

FIG. 12 shows a schematic view of an idealized Clausius-Rankine cycle of the ORC system of FIG. 1. In FIG. 12, the boundary of the vapour liquid coexistence region is indicated by a line 49. In an isentropic expansion step 4-1, the work fluid is expanded to a lower density while mechanical work is generated. In a cooling step 1-2 the work fluid is cooled down to the liquid phase. In the coexistence region, the heat loss is provided by removing the condensation heat such that this portion of the cooling step is isothermal. In an isentropic pumping step 2-3, the temperature of the work fluid is increased isentropically. In a heating step 3-4 the work fluid is heated until it reaches the vapour phase. In the coexistence region, the heat increase is absorbed by the vaporization heat such that this portion of the heating step is isothermal.

Figure 13:
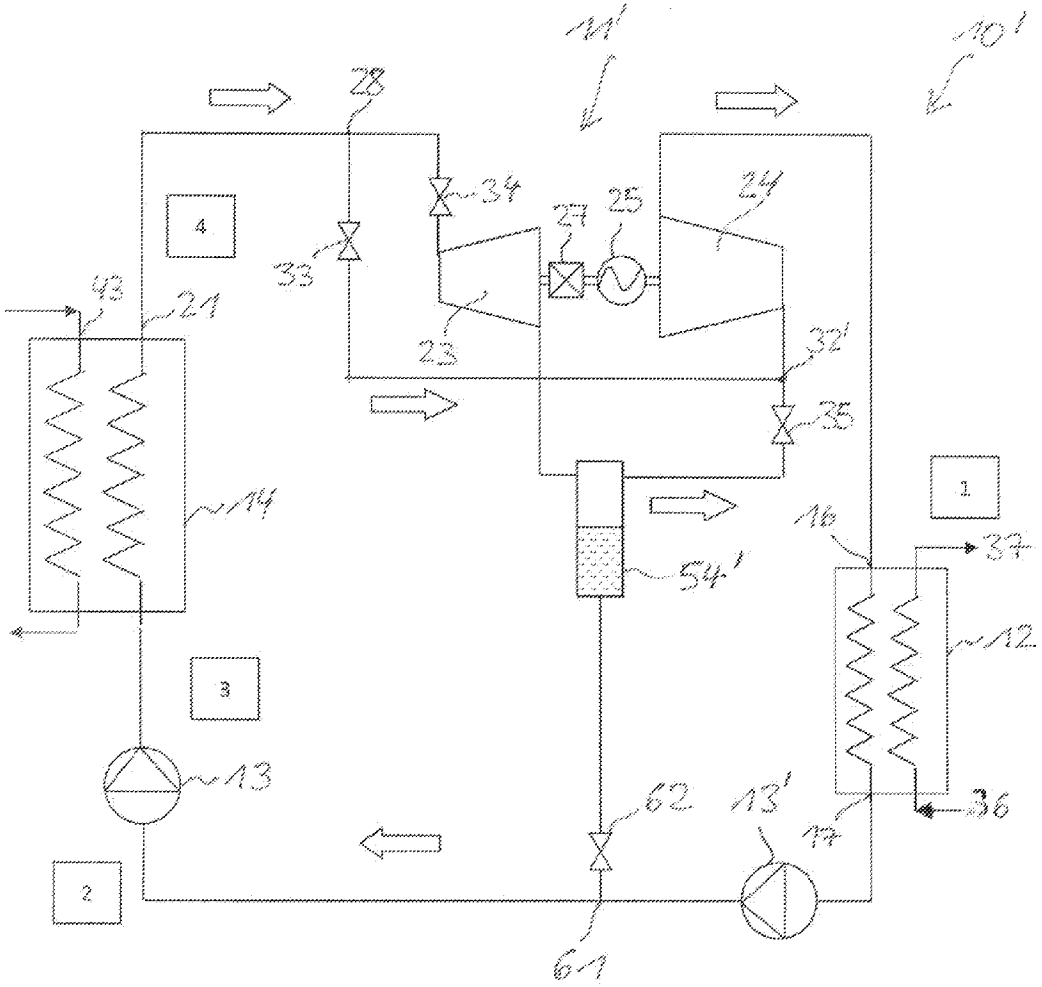
FIG. 13 shows a further embodiment of an ORC system having a separator chamber between first and second expander stages.

FIG. 13 shows a second embodiment of an ORC engine, in which the outlet of the high-pressure expander 23 is connected to an inlet of a second separator chamber 54' in a vapour region of the separator chamber 54', and a vapour outlet of the separator chamber 54' in the vapour region is connected to an inlet of the low-pressure expander 24. A liquid outlet of the separator chamber 54' in the liquid region is connected to a supply line for the feeder pump 13 at a branching point. A control valve 62 is provided between the liquid outlet of the separator chamber 54' and the branching point 61. Furthermore, a second feeder pump 13' is provided between the branching point 61 and the outlet 17 of the condenser 12.

Figure 14:
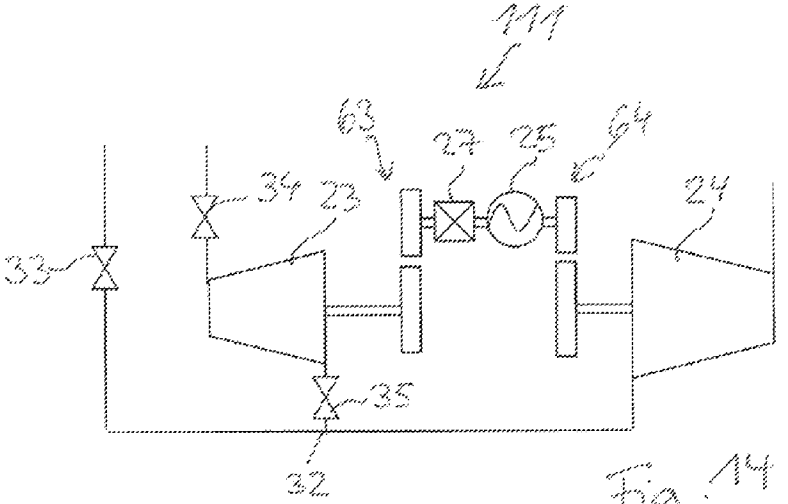
FIG. 14 shows a generation unit with a spur gear.

FIG. 14 shows a further embodiment of a generating unit 111 in which a first spur gear 63 is provided between an output shaft of the high-pressure expander 23 and a generator shaft, an a second spur gear 64 is provided between an output shaft of the high-pressure expander 24 and the generator shaft.

Figure 15:
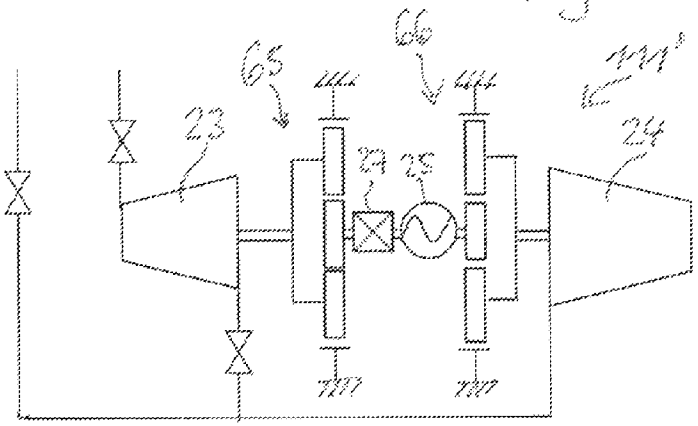
FIG. 15 shows a generation unit with two planetary gearsets.
Figure 16:
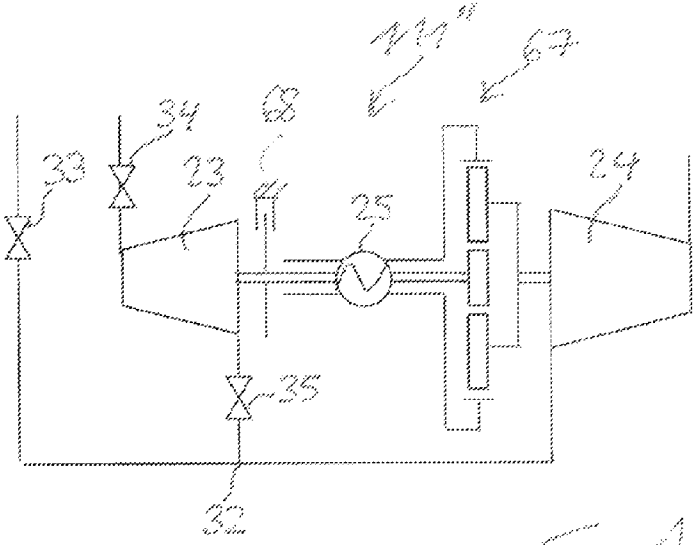
FIG. 16 shows a generation unit with a planetary type overriding drive.

FIG. 15 shows a further embodiment of a generating unit 111' in which a first planetary gear set 65 is provided between an output shaft of the high-pressure expander 23 and a generator shaft, and a second planetary gear set 66 is provided between an output shaft of the low-pressure expander 24 and the generator shaft.

In the first planetary gear set 65, a ring gear is connected to a casing of the generating unit 111', a planetary carrier is connected to the output shaft of the high-pressure expander 23, and a sun gear is connected to the generator shaft. Likewise, in the second planetary gear set 66, a ring gear is connected to a casing of the generating unit 111', a planetary carrier is connected to the output shaft of the low-pressure expander 24, and a sun gear is connected to the generator shaft.

FIG. 15 shows a further embodiment of a generating unit 111" in which a rotor of the generator is connected to a hollow shaft. The hollow shaft is connected to a ring gear of a planetary gear set 67. A planetary carrier of the planetary gear set 67 is connected to an output shaft of the low-pressure expander 24 and a sun gear of the planetary gear set 67 is connected to an output shaft of the high-pressure expander 23 which passes though the hollow shaft. A brake clutch 68 is provided to fix the sun gear of the planetary gear set 67 when the high-pressure expander 23 is not in operation.

During operation in a high temperature configuration in which valves 34 and 35 are open and the bypass valve 33 is closed, the planetary gear is driven as an overriding gear by both the sun gear and the planetary carrier. The direction of rotation of the expanders is designed such that the rotation speed of the hollow shaft is increased.

During operation in a low temperature configuration in which valves 34 and 35 are closed and the bypass valve 33 is closed, the planetary gear is driven by the planetary carrier and the sun gear is fixed by the brake clutch 68.

| Reference numbers | |
|---|---|
| 10 | ORC system |
| 11-11"", 111-111"" | Generating unit |
| 12 | condenser |
| 13 | feeder pump |
| 14 | evaporator |
| 15 | work fluid outlet |
| 16 | condenser inlet |
| 17 | condenser outlet |
| 18 | feeder pump inlet |
| 19 | feeder pump outlet |
| 20 | evaporator inlet |
| 21 | evaporator outlet |
| 22 | generating unit inlet |
| 23 | high-pressure expander |
| 24, 24' | low-pressure expander |
| 25 | generator |
| 27, 27' | freewheel device |
| 29 | high-pressure supply line |
| 30 | low-pressure supply line |
| 32 | branching point |
| 34 | input control valve |
| 35 | output control valve |

-continued

| Reference numbers | |
|---|---|
| 36 | cooling fluid source |
| 37 | cooling fluid sink |
| 38 | heat source |
| 39 | cooling water channel |
| 40 | work fluid channel |
| 41 | heating fluid channel |
| 42 | work fluid channel |
| 43 | heating fluid inlet |
| 44 | heating fluid outlet |
| 49 | coexistence region boundary |
| 50 | coupling/clutch |
| 51 | plate heat exchanger |
| 52 | preheater portion |
| 53 | evaporator portion |
| 54, 54' | separator chamber |
| 55 | liquid outlet |
| 56 | liquid inlet |
| 57 | vapour outlet |
| 58 | liquid inlet |
| 59 | liquid outlet |
| 60 | vapour outlet |
| 61 | branching point |
| 62 | control valve |
| 63 | first spur gear |
| 64 | second spur gear |
| 65 | first planetary gear |
| 66 | second planetary gear |
| 67 | planetary gear |
| 68 | brake clutch |

The invention claimed is:

1. An Organic Rankine Cycle system with a generating unit, a condenser for condensing an organic work fluid, a feeder pump for circulating the organic work fluid, an evaporator for evaporating the organic work fluid, wherein the generating unit comprises a high-pressure screw expander and a low-pressure screw expander which are connected in series, wherein the high-pressure screw expander and the low-pressure screw expander are mechanically connectable to a generator which is provided between the high-pressure screw expander and the low-pressure screw expander, and wherein the Organic Rankine Cycle system further comprises a by-pass line for bypassing the high-pressure screw expander, wherein the bypass line comprises a control valve for opening and closing the by-pass line.

2. The system according to claim 1, wherein the high-pressure expander is mechanically connectable to the generator via a freewheeling device.

3. The system according to claim 1 further comprising an input control valve and an output control valve, the high-pressure expander being arranged between the input control valve and the output control valve.

4. The system according to claim 1, wherein the generating unit comprises a first spur gear that is connected to the high-pressure expander and a second spur gear that is connected to the low-pressure expander.

5. The system according to claim 1, wherein the generating unit comprises a first planetary gear set that is connected to the high-pressure expander and a second planetary gear set that is connected to the low-pressure expander.

6. The system according to claim 1, wherein the generating unit comprises a planetary gear set, wherein a sun gear of the planetary gear set is connected to the high-pressure expander and a planetary carrier of the planetary gear set is connected to the low-pressure expander.

7. The system according to claim 1, further comprising a work fluid which is an azeotropic mixture, the azeotropic mixture comprising a first organic fluid with a normal boiling point above 35 degrees Celsius and a second organic fluid which is of low flammability.

8. The system according to claim 7, wherein the first organic fluid comprises a pentafluorobutane.

9. The system according to claim 7, wherein the second organic fluid comprises a perfluoropolyether.

10. The system according to claim 1, wherein the condenser comprises a plate heat exchanger.

11. The system according to claim 1, wherein the evaporator comprises a plate heat exchanger.

12. The system according to claim 1, wherein the expanders are oil-free expanders.

13. A ship engine with the system of claim 1, wherein the evaporator of the system is connected to an exhaust of the ship engine via a pipe.

14. A geothermal power station with the system of claim 1, wherein the evaporator of the system is connected to a pipe for a brine of the geothermal power station, the pipe being connected to the geothermal heat source via a borehole.

15. A method for operating an ORC system with a high-pressure expander and a low-pressure expander, the ORC system comprising a bypass line, wherein the bypass line extends from a branching point before the high-pressure expander to the low-pressure expander, and the ORC system comprises an input control valve before the high-pressure expander, the method comprising in a high temperature operating mode:

closing the bypass line and opening the input control valve, and, in a low temperature operating mode, opening the bypass line and closing the input control valve.

16. The method according to claim 15 further comprising the steps of measuring a temperature of a heat source, and automatically selecting one of the high-pressure operation mode and the low-pressure operation based on the temperature of the heat source.

* * * * *